US010109138B2

(12) United States Patent
Lundblad et al.

(10) Patent No.: US 10,109,138 B2
(45) Date of Patent: Oct. 23, 2018

(54) STACKING AND DISPENSING MODULE

(71) Applicant: NCR Corporation, Duluth, GA (US)

(72) Inventors: Leif J. I. Lundblad, Stockholm (SE); Claes Björkman, Stockholm (SE); Jan Mistander, Hägersten (SE); Peer-Åke Eskelius, Järfälla (SE)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/543,362

(22) PCT Filed: Jan. 22, 2016

(86) PCT No.: PCT/SE2016/050037
§ 371 (c)(1),
(2) Date: Jul. 13, 2017

(87) PCT Pub. No.: WO2016/118068
PCT Pub. Date: Jul. 28, 2016

(65) Prior Publication Data

US 2018/0005480 A1 Jan. 4, 2018

(30) Foreign Application Priority Data

Jan. 23, 2015 (SE) ..... 1550071

(51) Int. Cl.
*B65H 29/40* (2006.01)
*G07D 11/00* (2006.01)
(Continued)

(52) U.S. Cl.
CPC ..... *G07D 11/0036* (2013.01); *G07D 11/0084* (2013.01); *G07F 19/202* (2013.01);
(Continued)

(58) Field of Classification Search
CPC .. B65H 29/40; B65H 29/125; B65H 2403/92; B65H 2515/704; B65H 2555/25; B65H 2404/1114
See application file for complete search history.

(56) References Cited

U.S. PATENT DOCUMENTS 5,000,322 A 3/1991 Goi
5,756,985 A 5/1998 Holste et al.
(Continued)

FOREIGN PATENT DOCUMENTS

EP 1 732 046 A1 12/2006
WO 99/67750 A1 12/1999

OTHER PUBLICATIONS

International Search Report and Written Opinion for corresponding Patent Application No. PCT/SE2016/050037 dated May 24, 2016.

*Primary Examiner* — Jeremy R Severson
(74) *Attorney, Agent, or Firm* — Schwegman, Lundberg & Woessner

(57) ABSTRACT

A stacking and dispensing module (2) for use in an automatic teller machine (4), the module is configured to be arranged in connection with a banknote storage unit (6) comprising a banknote tray (8) on which banknotes (10) are stacked, the stacking and dispensing module (2) is configured to be in a banknote stacking mode, when banknotes are stacked in said storage unit (6), and in a banknote dispensing mode, when banknotes are dispensed from said storage unit (6). A stacking wheel member (12) is active both during the banknote stacking mode and during the banknote dispensing mode, and that the rotation of the stacking wheel member (12) is configured to be controlled by a first direct current (DC) motor (20), and the rotation of a dispensing wheel member (16) is configured to be controlled by a second DC motor (22). The module further comprises: —a current measuring unit (24) configured to measure the currents
(Continued)

applied to drive said first and second DC motors (20, 22) and to generate current signals (26, 28) in dependence thereto, —a control unit (30) configured to receive said current signals (26, 28), wherein the control unit (30) is configured to evaluate said current signals (26, 28) and to determine control signals (32, 34) for various functions of said module in dependence of said evaluation, and to apply said control signals for controlling said functions.

20 Claims, 8 Drawing Sheets

(51) Int. Cl.
*G07F 19/00* (2006.01)
*B65H 29/12* (2006.01)

(52) U.S. Cl.
CPC ..... *G07F 19/203* (2013.01); *B65H 29/125* (2013.01); *B65H 29/40* (2013.01); *B65H 2403/92* (2013.01); *B65H 2404/1114* (2013.01); *B65H 2515/704* (2013.01); *B65H 2555/25* (2013.01)

(56) References Cited

U.S. PATENT DOCUMENTS

| | | | | |
|---|---|---|---|---|
| 6,581,746 | B1 | 6/2003 | Lundblad | |
| 6,945,378 | B2 | 9/2005 | Lundblad | |
| 7,404,552 | B2 * | 7/2008 | Abe | B65H 7/06 209/534 |
| 8,485,432 | B2 * | 7/2013 | Holland-Letz | B65H 1/025 235/375 |
| 2003/0137096 | A1 * | 7/2003 | Ito | B65H 29/46 271/176 |
| 2004/0056086 | A1 | 3/2004 | Mason et al. | |
| 2005/0183926 | A1 * | 8/2005 | Deaville | B65H 29/00 194/206 |
| 2006/0169623 | A1 * | 8/2006 | Razzaboni | B65H 29/006 209/534 |
| 2012/0061905 | A1 * | 3/2012 | Wu | B65H 3/063 271/34 |
| 2014/0190787 | A1 | 7/2014 | Fujita et al. | |
| 2016/0052738 | A1 * | 2/2016 | Park | G07D 11/0027 271/227 |
| 2017/0369273 | A1 * | 12/2017 | Tracey | B65H 75/4486 |

* cited by examiner

STACKING AND DISPENSING MODULE

This application is a national phase of International Application No. PCT/SE2016/050037 filed Jan. 22, 2016 and published in the English language, which claims priority to Swedish Patent Application No. 1550071-3 filed Jan. 23, 2015, which are hereby incorporated herein by reference.

TECHNICAL FIELD

The present disclosure relates to an automatic teller machine (ATM) for cash deposits and/or withdrawals. In particular the present disclosure relates to a stacking and dispensing module to be arranged in connection with each of a plurality of banknote storage units, e.g. cassettes, arranged within an ATM. The present disclosure also relates to an ATM provided with an advanced upper unit having the capability of reducing user intervention when depositing banknotes.

BACKGROUND

In spite of numerous predictions of a cashless society, the amount of cash in circulation has not declined. There are today an estimated 360 billion transactions in the EU every year to be compared with 60 billion non-cash transactions. The handling of cash is a very cost consuming operation still involving a lot of manual handling and transportation to and from consumers, retailers, banks, cash centres and National banks. The cash is counted on numerous occasions during this circulation and the security problems are extensive. The annual cost for handling of cash in the European Union is around 50 billion Euros. Significant savings could be made if a more rationalized and decentralized system could be introduced. The common currency makes it possible to take significant steps towards a more efficient handling of cash within the European Union with potential cost savings amounting to billions of Euro.

One concept that provides a very cost efficient solution to the handling of banknotes is embodied by a local cash handling system, the so-called Q-CashRouter® concept, which is provided by the applicant to the present application. The Q-CashRouter® system is herein generally referred to as a local cash handling system. It is an innovative self-service unit for efficient recycling of banknotes. It allows retailers to deposit their daily takings in full parallel with private consumers withdrawing cash. Banknotes are recycled locally in the machine, which minimizes the need for expensive cash transports and costly control processing of deposited banknotes. The concept is ideal for locations like shopping malls with its high volume flow of notes between shops, banks and consumers.

The local cash handling system may be configured with e.g. three or even more consumer fascias. This allows e.g. a retailer to deposit bundles of unsorted notes, in full parallel with two private consumers making cash withdrawals. The multiple-fascia support radically improves the efficiency of cash recycling and eliminates the inconvenience for consumers to have to queue-up behind retailers making large volume deposits. During the same time as one retailer deposits a bundle of e.g. 250 notes, the local cash handling system can process up to twelve consumers withdrawing cash at the two side fascias.

Deposited notes are sorted, quality controlled, and checked for counterfeits. Only notes of good quality are recycled to customers by the local cash handling system. Excess good quality notes are sorted and bundled in single or multidenomination sealed packages, which can be used directly, e.g. for loading of ATMs and as small-change cash for retailers.

The local cash handling system may be installed in environments where large volumes of cash is processed every day, e.g. in supermarkets, in shopping malls and in larger bank branch offices. A supermarket could use the local cash handling system to build a private protected room. Cashiers deposit their daily takings in the local cash handling system and receive a receipt on the deposited amount. At the end of the day the deposited amounts are automatically reconciled with the amounts captured by the point of sale (POS) system. No manual counting or sorting of notes is required.

U.S. Pat. Nos. 6,581,746 and 6,945,378 relate to different aspects of the cash handling system described above. In addition it is referred to the following prior art documents also disclosing various aspects of cash handling systems: U.S. Pat. No. 5,000,322, US-2004/0056086, and U.S. Pat. No. 5,756,985.

These patents and patent application disclose in particular the storage and circulation of banknotes within the system required achieving the local cash handling, e.g. the handling of banknotes of different denominations being stored in different storage means to be available for withdrawals, and the handling of non-accepted banknotes being sorted out and stored separately in sealed transparent envelopes.

A conventional ATM is normally provided with removable banknote storage units, so-called cassettes, where deposited banknotes are stacked and stored, and where banknotes are dispensed from during withdrawal.

Dependent of the cash-flow and of type of ATM, empty cassettes are replaced by full cassettes if withdrawals exceed the deposits, and full cassettes are replaced by empty cassettes if deposits exceed the withdrawals. Each cassette must be docked into the ATM such that stacking of banknotes within the cassette is facilitated if the ATM is a dedicated deposit ATM, and if the ATM is dedicated for withdrawals it must have capabilities for dispensing the banknote from the cassette. And if the ATM is adapted for both deposits and withdrawals the cassette must be docked into the ATM such that both stacking and dispensing of banknotes in the cassette is facilitated.

An object of the present invention is to achieve an improved stacking and dispensing module to be used in connection with a banknote storage unit, e.g. a cassette, which module is robust, easy adaptable to various types of banknotes, has high capacity with regard to speed and essentially no, or very low, failure rate. An object is to achieve an improved ATM provided with an upper unit capable of improving the banknote depositing procedure.

SUMMARY

The above-mentioned object is achieved by the present invention according to the independent claim.

Preferred embodiments are set forth in the dependent claims.

The stacking and dispensing module according to the present invention is a compact module providing capabilities both for stacking of banknotes in a banknote storage unit, e.g. a cassette, and dispensing (feeding out) banknotes from the same unit. One stacking and dispensing module is intended to be arranged in connection with each banknote storage unit.

Features are provided to handle the high-speed stacking/feeding procedure keeping a very low failure rate. In addition, the construction of the recycling module results in a module being less complicated e.g. in that fewer sensors are required, has a considerably lower weight and power consumption, and thus being less expensive, in comparison to presently available modules.

Below some important features are listed:

- The precise and intelligent control of the stepping and direct current (DC) motors.
- The delicate control of the note lifting tray in the cassette ensuring exactly the correct pressure between the banknote and the feeding means.
- Active stacking wheels during both stacking and dispensing.
- The note-synchronized stacking wheel speed.
- The pressure control of note bundle during stacking and dispensing.
- Using the driving currents to the DC motors as measurement values for controlling various functions of the module.
- Automatically adapt the module for dispensing banknotes of different thickness, quality, etc.

The features of particular interest are the features related to the above advantages, i.e. related to achieving the high-speed stacking/dispensing procedure; the low failure rate, the lower weight, and the low power consumption.

The current consumptions of the DC-motors used to drive various structural details of the module are measured.

More specifically, the driving current for each DC motor is measured. As the driving current is dependent of the output force (torque) from the DC-motor a quantitative measure of the function performed by the DC motor is available, from the measured current, which measure is used for determining control parameters for the stacking and dispensing module.

By applying this insight the inventors have realized that the stacking and feeding module may have a more robust and simplified structure in comparison to modules where instead numerous dedicated sensors as well as complex mechanics must be arranged to detect parameters required to perform the delicate control of a high-speed stacking and dispensing module.

By measuring the driving currents, information is gained which is used to control various functions of the module. Thereby the module is made simpler and more robust in that this collected information may be used such that some sensors conventionally used for control purposes may be excluded.

The stacking wheel has an essentially circular shape, and has a predetermined thickness and the outer edge has an outer circumferential contact surface. During specific parts of both the stacking and dispensing procedure the contact surfaces of the stacking wheels are in contact with an upper surface of a banknote on a banknote lifting tray of a cassette. The contact with the upper surface of the banknote serves two purposes, firstly it levels the banknote, and secondly to control the level of the tray. More specifically, the stacking wheel is configured to be rotated by a DC-motor and the driving current of the DC motor is measured and the measured current value is used to control the level of the tray in the cassette.

Thus, the stacking wheel is used both during the stacking procedure and the dispensing procedure to control the level of the tray of the cassette.

In one embodiment an advanced upper unit is provided capable of reducing user intervention when deposited banknotes are detected as non-accepted. This is achieved by arranging a drum storage unit for temporary storage of non-accepted banknotes, and then automatically feeding those non-accepted banknotes at least a second time through the detection unit, and turning the banknote upside down for each consecutive passage.

DETAILED DESCRIPTION

Figure 1:
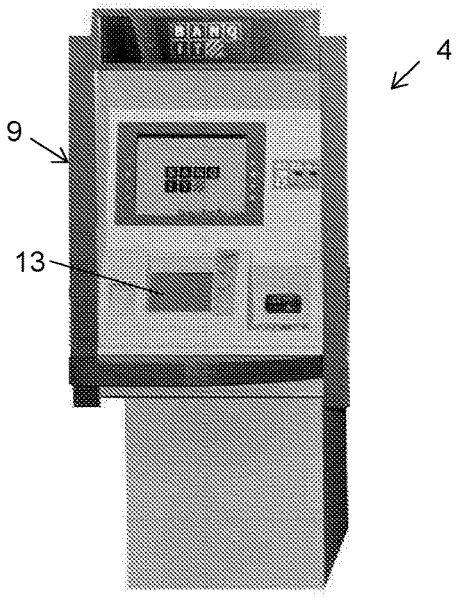
FIG. 1 is an image of an automatic teller machine (ATM) according to the present invention.

Throughout the figures the same, or similar, items will have the same reference signs. FIG. 1 is an image of an automatic teller machine (ATM) 4, provided with a user interface 9, according to the present invention. The illustrated ATM has one fascia which could be applied for deposits only, for withdrawals only, or for both deposits and withdrawals if local recycling of banknotes is implemented.

Figure 2:
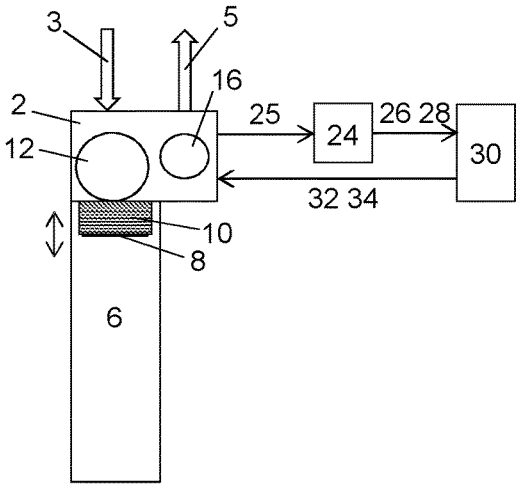
FIG. 2 is a simplified block diagram schematically illustrating the stacking and dispensing module according to the present invention.

FIG. 2 is a simplified block diagram schematically illustrating the stacking and dispensing module 2 according to the present invention.

In the figure one stacking and dispensing module 2 for use in an ATM 4 is illustrated. The flow of banknotes to be stacked is indicated by an arrow 3, and the flow of banknotes to be dispensed is indicated by an arrow 5.

The module is configured to be arranged in connection with a banknote storage unit 6 comprising a banknote tray 8, on which banknotes 10 are stacked.

A conventional ATM is normally provided with removable banknote storage units, so-called cassettes, where deposited banknotes are stacked and stored, and where banknotes are dispensed from during withdrawal.

Dependent of the cash-flow and of type of ATM, empty cassettes are replaced by full cassettes if withdrawals exceed the deposits, and vice versa. Each cassette must be docked into the ATM such that stacking of banknotes within the cassette is facilitated if the ATM is a dedicated deposit ATM, and if the ATM is dedicated for withdrawals it must have capabilities for dispensing the banknote from the cassette. And if the ATM is adapted for both deposits and withdrawals the cassette must be docked into the ATM such that both stacking and dispensing of banknotes in the cassette is facilitated.

Figure 3:
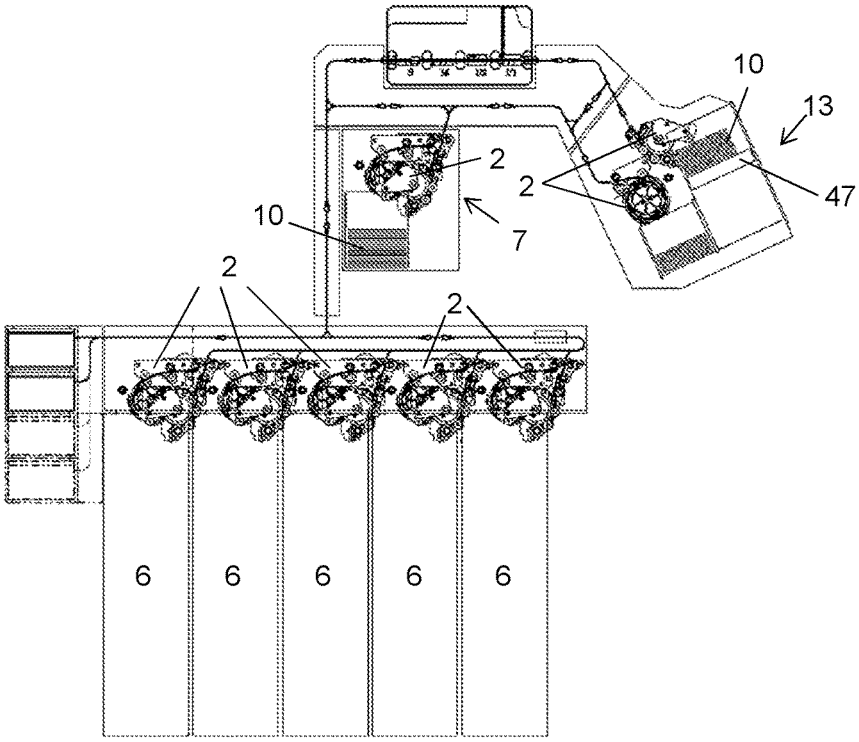
FIG. 3 is a cross-sectional view schematically illustrating an ATM including stacking and dispensing modules according to the present invention.

The stacking and dispensing module may also be arranged in connection with a so-called escrow unit 7, which is an intermediate storage unit (see FIG. 3).

FIG. 3 is a cross-sectional view schematically illustrating an ATM including stacking and dispensing modules according to the present invention. In the illustrated ATM five cassettes 6 are arranged. One stacking and dispensing module 2 is arranged in connection with each of the cassettes 6, and in connection with the escrow unit 7. A user interface 9 where a user may deposit and/or withdraw banknotes from the ATM is provided. The possible routes for banknotes within the ATM are schematically illustrated by small arrows. Additional structural details are also shown in the figure but will not be discussed in detail as they are commonly known technique.

Figure 4:
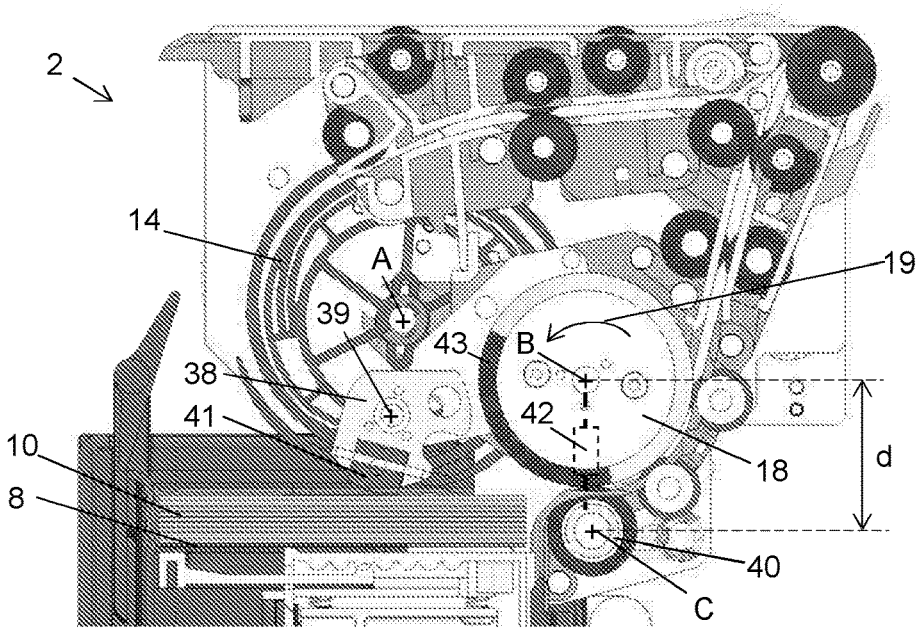
FIG. 4 is a cross-sectional side view illustrating the stacking and dispensing module according to the present invention in a banknote dispensing mode.
Figure 5:
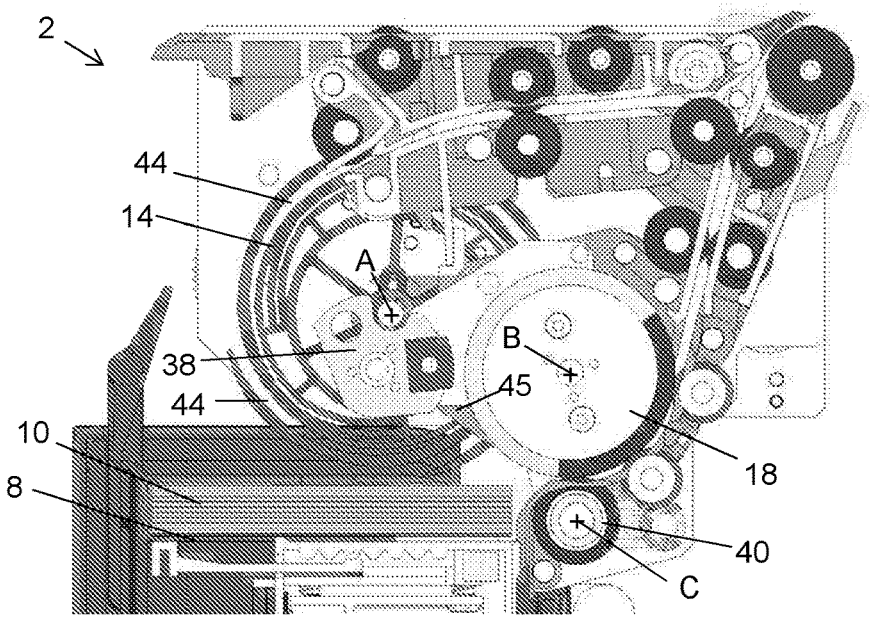
FIG. 5 is a cross-sectional side view illustrating the stacking and dispensing module according to the present invention in a banknote stacking mode.

The stacking and dispensing module 2 is configured to be in a banknote stacking mode, which is illustrated in FIG. 5, when banknotes are stacked in the storage unit 6, and in a banknote dispensing mode, which is illustrated in FIG. 4, when banknotes are dispensed from the storage unit 6.

FIGS. 4-7 illustrate various view of the stacking and dispensing module according to the present invention. In those figures only features being essential for describing the present invention will be referenced to. Thus, for sake of simplicity numerous structural details, e.g. rollers, guiding members, bars, shafts, etc. will not be described herein.

The stacking and dispensing module comprises a stacking wheel member 12 (see FIG. 2), which is configured to receive and stack banknotes on the tray 8. The stacking wheel member 12 comprises at least two stacking wheels 14 distributed along a common rotation shaft A having a longitudinal rotation axis designated with dashed lines (see FIGS. 4-6). Preferably, the stacking wheels 14 are distributed along the common rotation shaft A, such that they essentially cover a major part of a banknote 10 on the banknote tray 8, thereby performing a levelling of the banknote in a horizontal plane. In the module illustrated in FIG. 6, the stacking wheel member 12 comprises four stacking wheels 14 which are essentially symmetrically distributed along the rotation shaft A.

The stacking and dispensing module also comprises a dispensing wheel member 16 (see FIG. 2), which is configured to dispense banknotes from the tray 8. The dispensing wheel member 16 comprises a predetermined number of dispensing wheels 18 (see FIGS. 4, 5, 7) arranged for rotation around a common first rotation shaft B having a longitudinal rotation axis designated with dashed lines, and that the dispensing wheels 18 are configured to be rotated in a first dispensing direction, see arrow 19 in FIG. 4, when banknotes are dispensed from the storage unit 6.

The dispensing wheel member 16 is configured to receive banknotes moved from the stack of banknote in the banknote storage unit 6 by a banknote moving member 38. The banknote moving member 38 is mounted on a shaft 39 which is parallel to shaft B. It is provided with a contact surface 41 made from a high frictional material, e.g. rubber, such that when the moving member 38 is rotated the vertical position of the tray is such that the banknote on top of the stack is moved to the right in the figure to a position where the rotating dispensing wheels, and in particular specific parts 43 of the circumferential edge surfaces, which also are provided with e.g. rubber, continue the movement of the banknote to the right. The rotations of the moving member 38 and the rotating dispensing wheels are synchronised.

The stacking and dispensing module comprises a predetermined number of separating rolls 40 for cooperation with the dispensing wheels 18 during movement of banknotes. The separating rolls 40 are arranged for rotation around a common second rotation shaft C having a longitudinal rotation axis designated with dashed lines, being parallel to shaft B. FIG. 7 is a view from the opposite side compared to FIG. 6 specifically illustrating how the dispensing wheels 18 and the separating rolls 40 are arranged in relation to each other.

In the illustrated example four dispensing wheels 18 and five separating rolls 40 are interleaved such that there is a slight overlap between adjacent rolls and wheels in the virtual plane where the banknote will pass. This results in that the banknote will be slightly corrugated during passage.

The respective contact surfaces on the outer circumferential edge of the dispensing wheels and the separating rolls are made from a high frictional material, e.g. rubber.

Furthermore, the dispensing wheels 18 are advantageously configured to be rotated in a second returning direction, opposite to the first direction, where banknotes are returned to the banknote storage unit 6.

The rotation of the separating rolls 40 is only allowed for cooperating with the dispensing wheels 18 when the dispensing wheels rotate in the returning direction, but prevented in the opposite direction.

Thus, the dispensing wheels are configured to be rotated in a first dispensing direction where banknotes are dispensed from the cassette and in a second returning direction where banknotes are returned to the cassette, e.g. in case of detection of two or more banknotes that arrives at the same time which may be the case if they stick together, etc.

In one embodiment of the present invention a movement member 42 is provided which is configured to vary the perpendicular distance d between the shafts B and C in dependence of a second control signal 34 from a control unit 30. The movement member 42 is e.g. a stepping motor. The distance d between shafts B and C is variable, and in particularly it is automatically variable. By varying the distance d it is possible to automatically adapt the module for dispensing banknotes of different thickness, quality, etc. A typical overlap of the dispensing wheel and rollers is 0.25 mm and the variation may be in steps of 0.01 mm.

If the driving current of the DC motor configured to drive the dispensing wheels deviate from a set value a possible reason may be that two or more banknotes stick together and have been moved from the stack by the banknote moving member. The increased thickness of the banknotes results in that a higher torque, and then consequently a higher driving current, is required for rotating the dispensing wheels.

This enables a robust and straightforward detection of non-accepted situations, e.g. situations where two or more banknotes are moved or when a banknote is folded, etc. This detection method obviates the need of dedicated sensors and immediately adapts the dispensing capability to the actual situation, i.e. the thickness of the banknote.

Thus, if it is detected that two, or more, banknotes have been moved from the stack, these are returned to the stack and some further attempts are made, e.g. two or three. If, after the last attempt, it is still detected that the thickness deviates from an acceptable thickness the two (or more) banknotes will be fed out and rejected.

Figure 6:
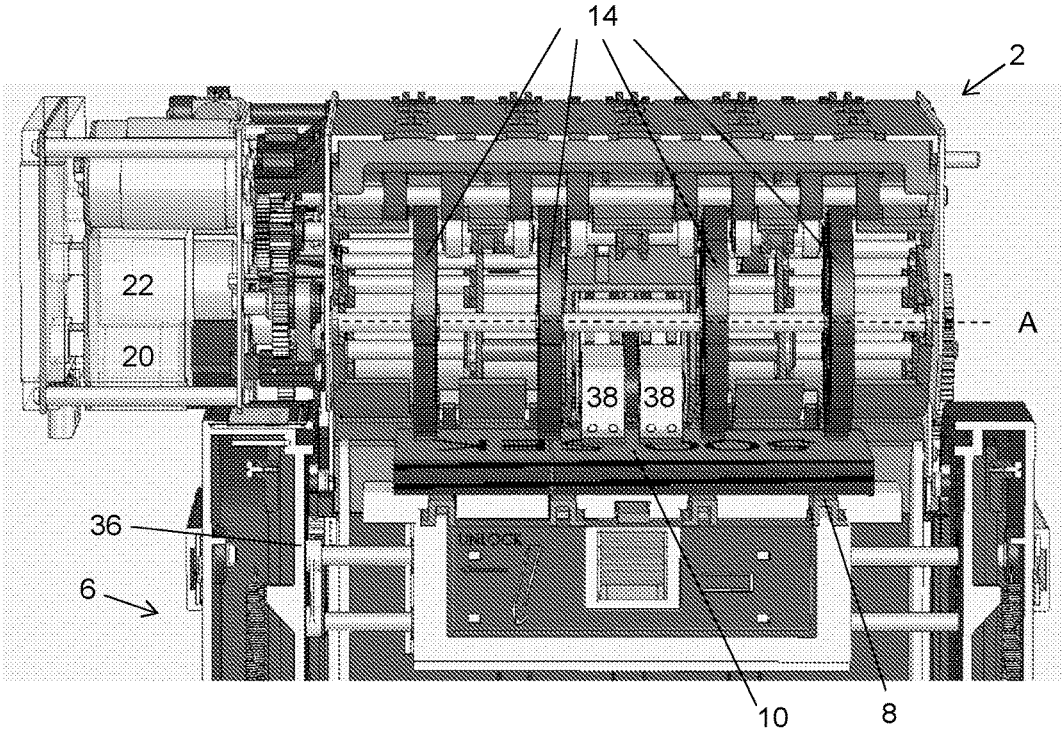
FIG. 6 is a front view illustrating the stacking and dispensing module according to the present invention.
Figure 7:
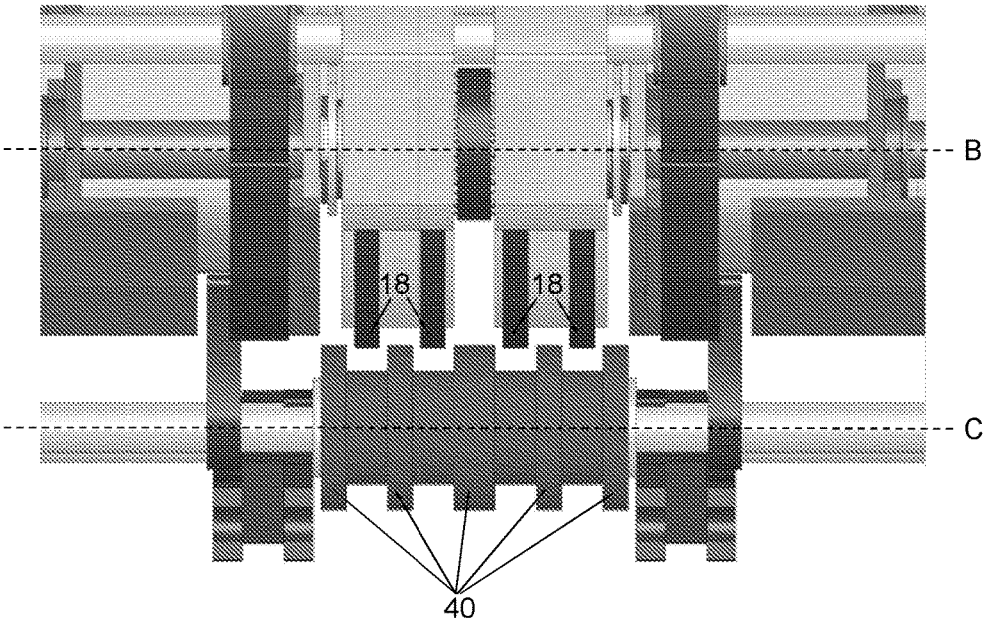
FIG. 7 is a view from the opposite side compared to FIG. 6 illustrating the stacking and dispensing module according to the present invention.

The stacking wheel member 12 is active both during the banknote stacking mode and during the banknote dispensing mode, and the rotation of the stacking wheel member 12 is configured to be controlled by a first direct current (DC) motor 20 (FIG. 6).

The rotation of the dispensing wheel member 16 is configured to be controlled by a second DC motor 22 (FIG. 6).

The module according to the present invention further comprises a current measuring unit 24 configured to measure the currents 25 applied to drive the first and second DC motors 20, 22 and to generate current signals 26, 28 in dependence thereto. There are several methods of measuring current, the most common method is to perform an indirect measurement by measuring the voltage across a precision resistor and using Ohm's law to measure the current across the resistor.

A control unit 30 is provided configured to receive the current signals 26, 28, and to evaluate the current signals 26, 28.

The control unit is further configured to determine control signals 32, 34 for various functions of the module in dependence of the evaluation, and to apply the control signals to various parts of the module for controlling the functions. The evaluation of the current signals 26, 28 comprises comparing current values to predetermined threshold values related to the respective functions.

The functions comprise at least one of controlling the vertical movement of the tray 8 and controlling a dispensing wheel member parameter, which preferably is related to the thickness of one banknote.

In one embodiment the control unit 30 is configured to determine a first control signal 32 in dependence of the current signal 26 from the first DC motor 20, and to apply this first control signal 32 to a tray movement member 36 to perform vertical movement of the tray 8.

The stacking wheel member 12 is active in the sense that it is rotated and current is measured both during the banknote stacking mode and banknote dispensing mode. This means that a measure of the friction between the stacking wheels and the top banknote at the stack is determined continuously by measuring the driving current of the first DC motor. This measure is related to the level of the tray such that a high friction value (higher driving current) means that the tray must be lowered, and vice versa. Acceptable friction values correspond to a range of acceptable vertical levels of the top banknote for achieving high quality stacking and dispensing procedures.

In one implementation the vertical position of the tray is automatically adjusted upwards or downwards e.g. every fourth banknote being dispensed or stacked, respectively. A typical adjustment is 0.25 mm. The measurements performed by the control unit by evaluating the driving current of the first DC motor results in an improved control of the vertical tray level.

To perform the stacking action each stacking wheel 14 is provided with a predetermined number of banknote receiving slots 44, e.g. three slots. Each slot has an essentially semi-circular curvature running from an outer edge of the wheel in a tangential direction in the outer third part of the radius of the stacking wheel, wherein the radius of the slot curvature essentially corresponds, or is slightly shorter, to the radius of the stacking wheel. Thereby is achieved that the banknote is received and stacked smoothly in that it is only bent as little as possible in its shorter direction.

A banknote enters the slot when the entry opening is positioned upwards and is properly positioned in relation to the route leading the banknote to the module. The banknote is fed into the slot until it reaches the end point of the slot. As the stacking wheel rotates the leading edge of the banknote comes into contact with a banknote stop member 45 which enables smooth delivery of the banknote to the stack in the cassette.

The present invention also relates to an automatic teller machine (ATM) comprising a predetermined number of banknote storage units 6, wherein each storage unit is provided with a stacking and dispensing module as described above. The ATM may have one or several customer fascia and may be adapted for deposits, withdrawals, and also for combined ATMs, allowing both deposits and withdrawals.

The stacking and dispensing module also comprises a gate member which is used to switch and guide banknotes into the route leading to the stacking wheel. It is controlled by a solenoid switch and is spring-loaded such that it enables a fast and bounce free switching.

In one optional implementation a camera unit is arranged in relation to a deposit tray where a user deposits banknotes, e.g. in relation to the user interface 9. The camera unit is intended to visually identify the banknote(s) being deposited and capture an image of the banknote(s). The captured image is compared to a corresponding reference banknote image. If the result of the comparison indicates that the deposited banknote differs too much from the reference banknote image the user is notified, either by a message on an interface display or audibly, that the banknote not will be accepted. The reason could be that the deposited banknote is folded or damaged, etc. The user may then remove the banknote, and try once more.

With references to FIG. 3 the user interface 9 will be further described. In one implementation the stacking and dispensing module 2 is arranged in connection with the user interface 9. A deposit tray 47 is provided where a user may deposit a bundle of banknotes 10. The deposit tray is hidden by a shutter 13 (see FIG. 1) when the ATM not is in use. When a deposition of banknote is about to take place the shutter 13 will open, e.g. when the user inserts a card. During the opening the shutter will move downwards until its upper edge reaches the level of the deposit tray which makes it easy to deposit a bundle of banknotes. The size of the opening is set in advanced by the ATM administrator in relation to the maximum size of the bundle of banknotes that should be allowed to be deposited, e.g. representing 200, 300, or 500 banknotes. Thus, the shutter 13 is movable and controlled together with the tray 47 such that the tray and shutter enables easy deposition of the banknote bundle. During the next step of deposition the dispensing wheel member together with the moving member will move banknotes from the deposit tray 47 to a banknote storage unit. During this procedure a corresponding measurement of the thickness of the banknotes as described above is performed.

In the following a further embodiment of the automatic teller machine will be disclosed with references to FIGS. 8-14.

A new type of advanced upper unit 52 is applied which is structured to implement an advantageous functionality. This new type of upper unit 52 is structured to be arranged in connection with, and work in combination with, the stacking and dispensing module described above with references to FIGS. 1-7, and in an ATM, provided with a lower unit 54 comprising stacking and dispensing modules, cassettes, and other items described in relation to the ATM disclosed herein. For case of simplicity the stacking and dispensing modules have been obviated in some of the FIGS. 8-14.

In a presently used solution, banknotes which are not accepted by the ATM are returned to the user that is instructed to reinsert/redeposit the banknote once more, e.g. after having unfolded it, or after having flattened it out, etc. This may result in irritation of the user and also has the consequence that the capacity of the ATM is reduced as the queue increases.

An object to be achieved by implementing the new type of advanced upper unit, and a new procedure in relation thereto is to reduce manual interference of ATMs of today when depositing banknotes.

A user deposits a bundle of banknotes on a deposit tray. The banknotes are fed one by one through a detector unit provided with various sensors for determining a number of different parameters of the banknote is dependent of measurements performed by the sensors. These parameters may include to determine the banknote denomination; the banknote quality, e.g. to determine if the banknote is dirty, ink-dyed, etc.; the authenticity of the banknote; if the banknote is folded, etc.

Based upon the state of these parameters it is determined how to handle the banknote.

The alternatives may be:

Not accept the banknote.

Accept the banknote.

The criteria for determining if a banknote should be accepted or not accepted may vary in dependence of specific regulation of the country where the ATM is installed.

In the ATM illustrated in FIGS. 8-14 an intermediate storage module is arranged in connection with the detector unit.

The intermediate storage module comprises at least two so-called drum storage units, one dedicated for accepted banknotes, a first drum storage unit (herein also denoted Escrow storage), and one dedicated for non-accepted banknotes, a second drum storage unit (herein also denoted temporary storage).

A drum storage unit is a commonly used type of storage module where banknotes are stored serially, up-winded in a drum. In U.S. Pat. No. 8,186,673 is disclosed one example of a drum storage which may be applicable when realizing the present invention.

The basic idea governing the implementation of the advanced upper unit 52 (see FIG. 8) is to let a banknote that was determined non-accepted by the detection unit pass the detection unit at least a second time without feeding it out to the user. In addition the banknote is turned upside down in comparison to when the banknote first passed through the detection unit during a first detection procedure. By turning the banknote upside down is herein meant that the side of the banknote facing downwards is turned upwards.

Thereby, according to gained experience, some of the non-accepted banknotes will instead be determined as accepted. Naturally, it is possible to turn the banknote one or many additional times and pass the banknote through the detection unit additional times.

Thus, the non-accepted banknotes are serially stored in the second drum storage unit. The banknotes are then fed into the detection unit one more time, in a turned state and being fed through the detection unit in the same direction as the first time.

The detection unit is adapted to only receive banknotes in one feeding direction. This is advantageous in that a less advanced and thus less expensive detection unit is then required which reduces the error rate and the detection unit is therefore more reliable.

It is also important to have the banknotes in a central position, e.g. in a mid-position, of the conveyer belt/transport track. This is an important aspect when the banknotes enter the storage cassettes in the lower part of the ATM in order to provide for an optimal stacking procedure inside the cassette such that a stable pile of banknotes within the cassette is achieved. Therefore, a banknote adjusting unit (or centralizer) C is provided. This unit is configured to centre the banknotes when they are fed along the transport track. The adjusting unit may be provided at various positions along the conveyor belt in the advanced upper unit 52. One advantageous position is to arrange the adjusting unit C along an upper conveyer route 50 (see FIG. 8) between the ES/TS storage units and the I/O module. As an alternative the adjusting unit C is instead arranged between the I/O module and the detection unit BV. The adjusting unit C is indicated by a rectangle having a dashed borderline, and will be described more in detail below with references to FIG. 13.

Figure 8:
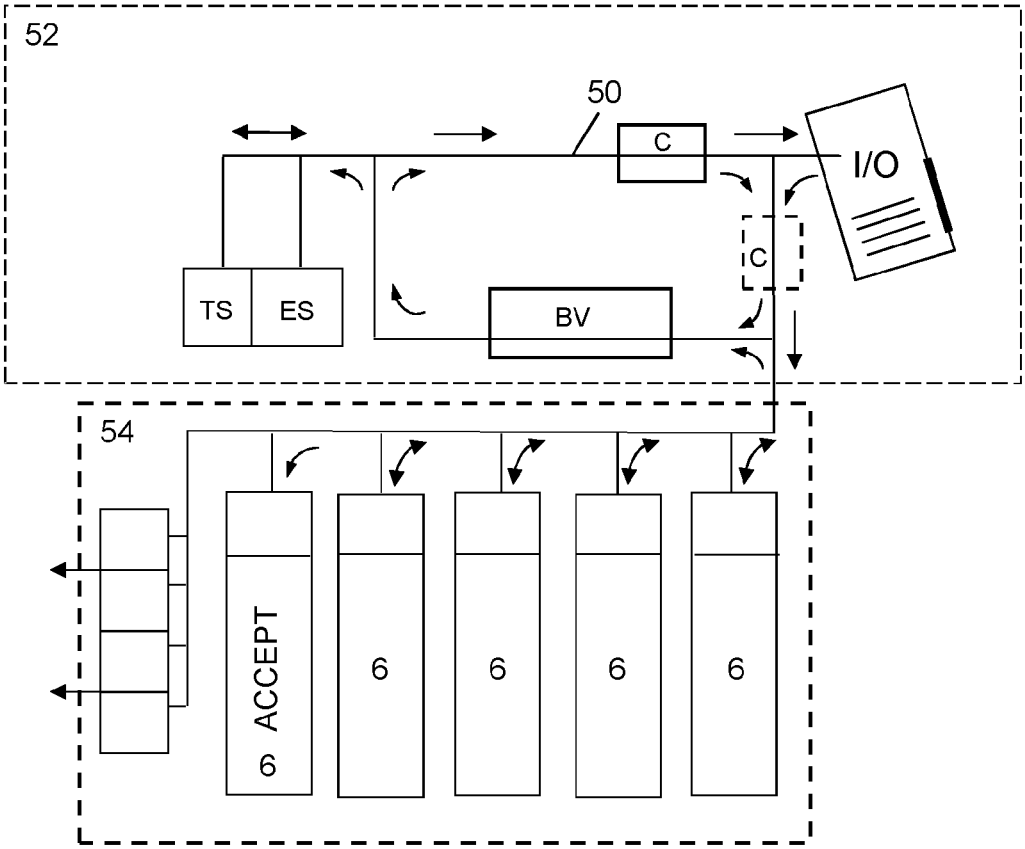
FIGS. 8-14 illustrate various aspects of an embodiment of the present invention.

FIG. 8 shows a schematic illustration of an automatic teller machine according to an embodiment of the present invention including the advanced upper unit 52. In the figure the following abbreviations have been used:

An I/O module—an input/output module where the user deposits/withdraws banknotes.

An Escrow storage (ES) of drum type, also denoted first drum storage unit. This is a temporary storage unit for deposited banknotes being accepted.

A Temporary storage (TS) of drum type for non-accepted banknotes, also denoted second drum storage unit. The TS is used for automatic banknote retry if detection is vague, i.e. if the detection unit concludes that the banknote not is accepted according presently applied criteria. It thereby reduces the need for customer intervention. The banknotes are temporarily stored herein and are fed out at least once more and passed through the detection unit. The banknotes are then transported along the upper conveyor route 50. As the TS is a drum type storage and in combination with the chosen transportation route the banknotes will then be turned upside down, in comparison to when they passed the detection unit before they were stored in the TS.

A banknote adjusting unit (C). This unit is structured to adjust the banknote to be in a central position at the conveyor belt performing the transportation of banknotes. The banknote adjusting unit is preferably arranged along an upper conveyer belt and prior the banknote is transported to cassettes 6. As will be discussed below the banknote adjusting unit may be implemented by so-called omni-wheels.

A banknote validator (BV), or detection unit. It should be noted that banknotes may only pass the detection unit in one direction, in the figure from the right to the left.

Banknote cassettes (used for recycling purposes) 6.

At least one acceptance cassette (used for deposit purposes) 6.

Figure 9:
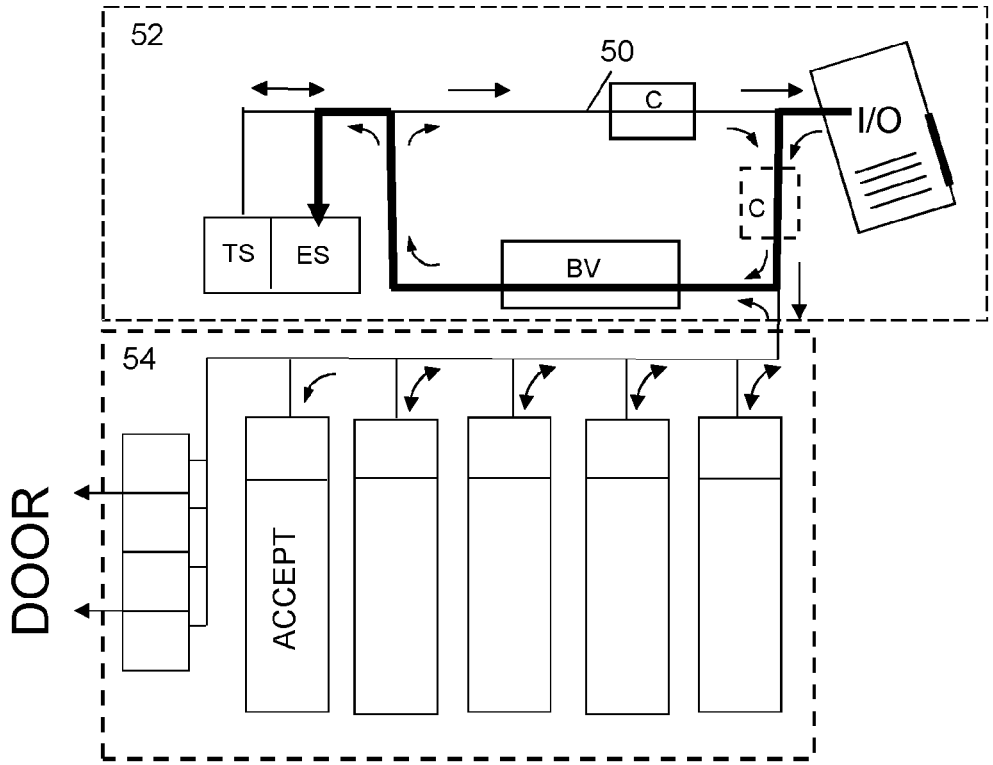
Figure 10:
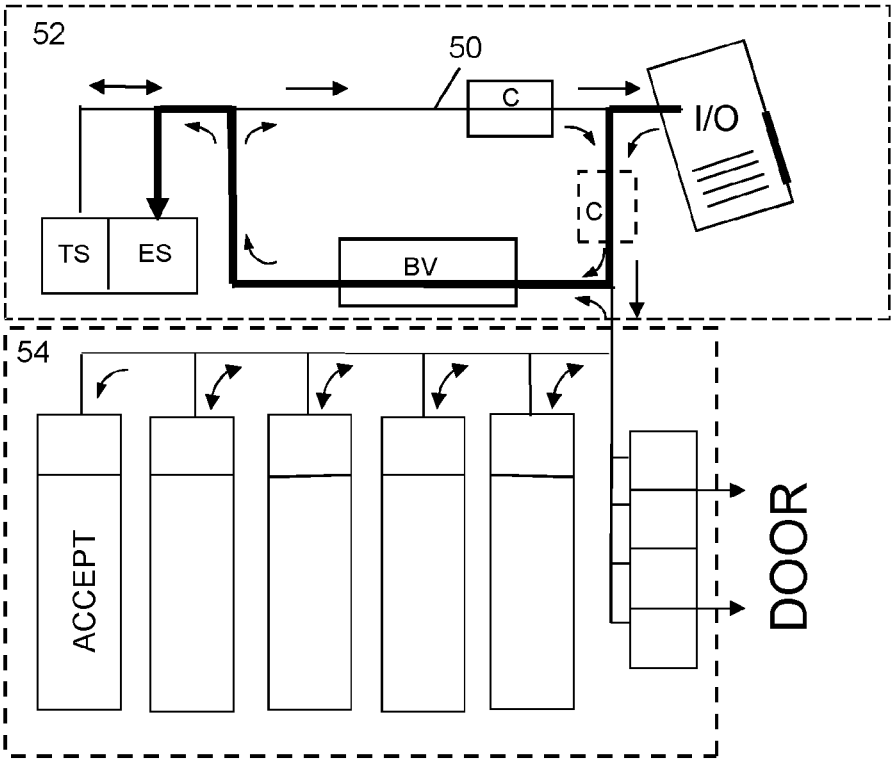

FIGS. 9 and 10 illustrate the functions during a normal deposit procedure where all deposited banknotes are accepted.

All notes deposited in the I/O module are sent to the Escrow module (ES) via the detection unit (BV) and optionally via the banknote adjusting unit C.

As all banknotes are accepted they are routed to the Escrow module. Thereafter, i.e. when all banknotes have been stored in the Escrow module, they are transported to one or many of the cassettes 6, via the upper conveyor route 50 and the banknote adjusting unit C.

The bold line illustrates the route of the accepted banknotes from the I/O module to the Escrow module.

FIGS. 9 and 10 illustrate the same procedure, and the only difference is in relation to the cassette part of the ATM in relation to which side the door (DOOR) to the safe is arranged. At the same side as the door is arranged some further storage units are provided which are indicated in the figures by four squares. These may include storage units adapted for e.g. retracted or rejected banknotes. The handling of non-accepted banknotes is governed in accordance with country specific regulations, which not will be further discussed herein.

Figure 11:
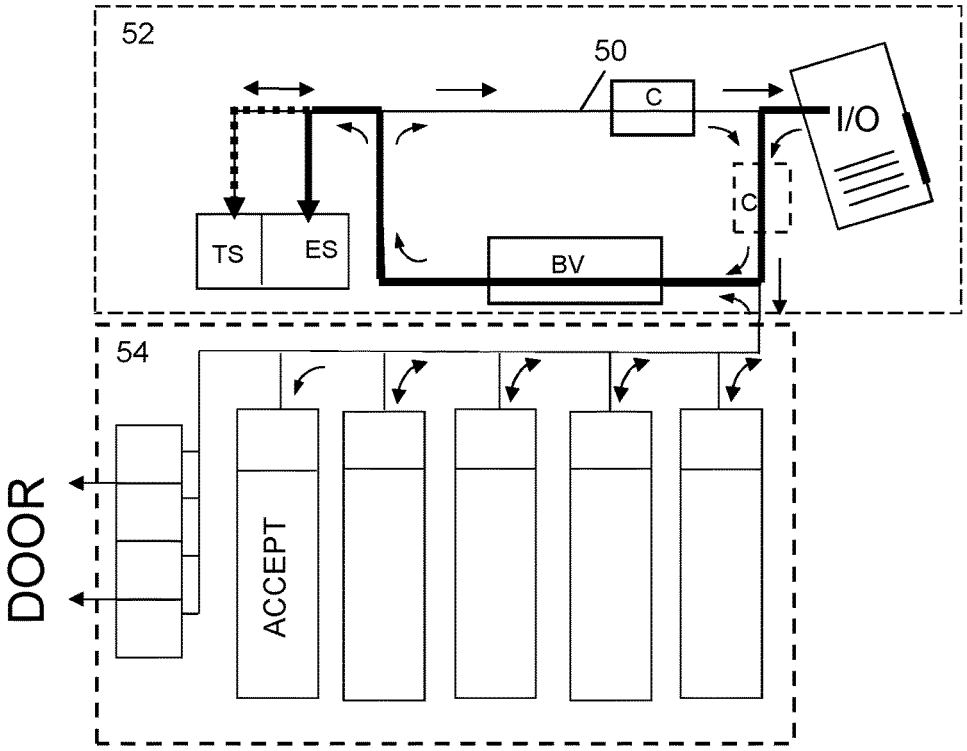
Figure 12:
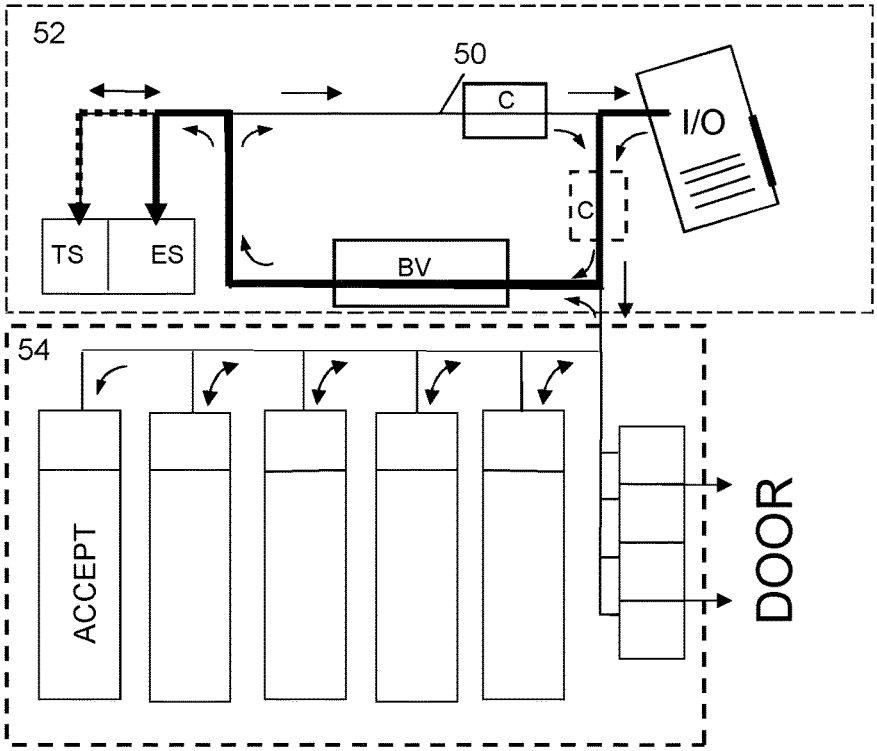

FIGS. 11 and 12 illustrate the functions where some banknotes are not being accepted, and then being fed through the detector unit again.

Accepted banknotes deposited in the I/O module are sent to the Escrow module via the detection unit (BV) and optionally the banknote adjusting unit C.

Non accepted banknotes are sent to the TS. As discussed above the non-accepted banknotes may include banknotes not possible to detect, forgeries and suspected banknotes.

The bold line illustrates the route of the banknotes. If a banknote was found accepted by the BV the banknote is routed to the ES which is illustrated by a bold line. If the banknote was found non-accepted it is routed to the TS which is illustrated by a bold dashed line. Thereafter when all banknotes are received, the non-accepted banknotes are fed out from the TS, via the upper route 50 and the banknote adjusting unit C and through the detector unit BV once again. Accepted banknotes are then routed to ES and if any non-accepted banknotes are detected after this second passage through the detection unit the non-accepted banknote may be routed to TS, e.g. for one more passage through the detection unit, or may be returned to the user directly via the I/O module without storing it in the TS, or may be fed to a cassette in the lower part of the ATM. Which of these alternatives that applies is e.g. dependent on country-specific regulations.

FIGS. 11 and 12 illustrate the same procedure, and the only difference is in relation to the cassette part of the ATM in relation to which side the DOOR is arranged.

The adjusting unit C is provided with a banknote centring member.

Preferably, the centring member comprises a number of so-called omni-wheels specifically arranged to perform the centring action.

Omni-wheels or poly wheels, similar to Mecanum wheels, are wheels with small discs around the circumference which are perpendicular to the turning direction. The effect is that the wheel can be driven with full force, but will also slide laterally with great ease. These wheels are often employed in holonomic drive systems.

Figure 13:
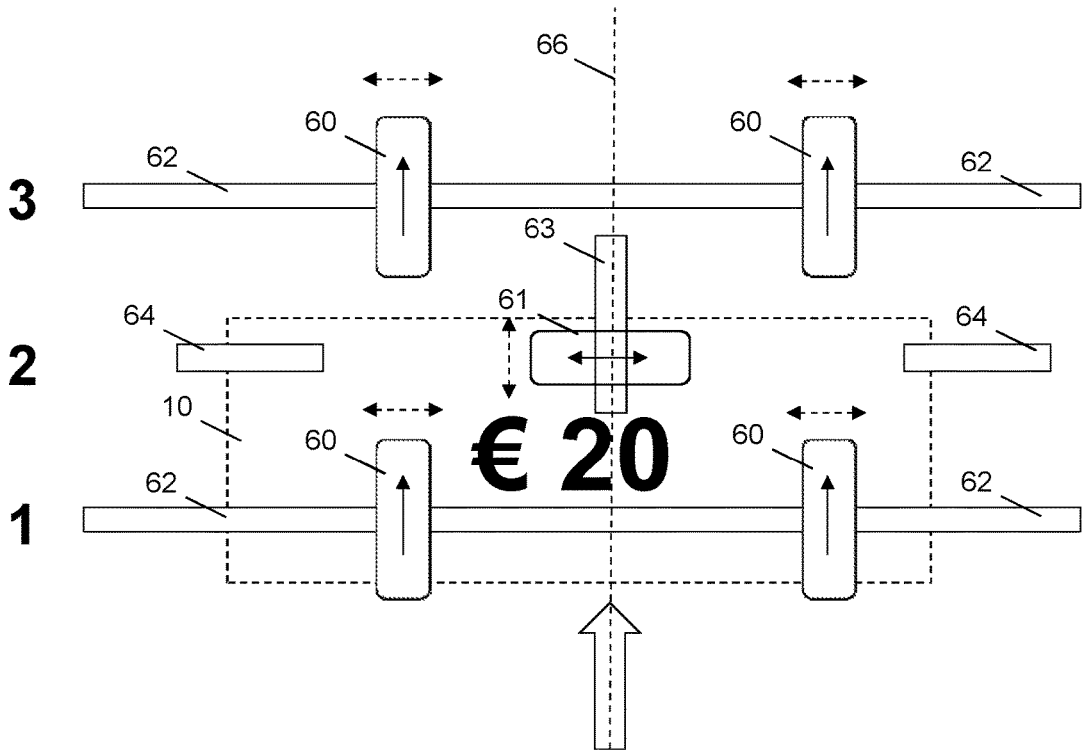

With references to FIG. 13 the function of the banknote centring member according to one embodiment will be described in detail.

In the schematic figure the banknote 10 will enter the banknote centring member from below at centralization station 1 (indicated by a bold number to the left) which is illustrated by a block arrow and the banknote will be transported in that direction. The banknote will then continue through the banknote centring member C and pass centralization stations 2 and 3.

The banknote centring member comprises a predetermined number (two or more) of omni-wheels 60, 61 which enables simultaneous movement in a direction perpendicular to the transport direction, which is in the left-right direction in the figure and which is illustrated by dashed double-arrows. The omni-wheels are rotated by motors (not shown) via driving shafts 62, 63.

The centralization station 2 is provided with at least one omni-wheel 61 positioned in 90° angle to the transportation wheels 60 coupled to a separate motor being configured to rotate the wheel via the shaft 63 in both clockwise and counter-clockwise direction at different speeds.

At least two optical array units 64 are provided and positioned on equal distances from the centreline 66 of the transport path. When the banknote obstructs the array units the difference of the incoming light between the two array units are measured and the motor is configured to be controlled to move the banknote towards the direction with highest light value. When the light values of the array units are essentially equal the banknote is considered to be centred with respect to the centreline of the transport path and the motor is stopped. The station 2 is now ready to receive the next banknote without any need to reset or reposition any mechanical parts.

The banknote 10 will exit the banknote centring member at station 3 which also is provided with omni-wheels 60 being configured to allow the banknote to move freely in a direction perpendicular to the transport direction while it is transported in the transport direction. The exit station can be utilized with two wheels on a common shaft 62 or have the wheels separated on individual shafts, which also is applicable for station 1. In the latter case with separate shafts and an extra motor connected to at least one of the shafts and controlled in a similar way as the centralization station also the skew angle (the banknote's angle relative to the centreline 66 of the transport path) of the banknote may be adjusted by controlling the respective shaft such that the two wheels will have a slightly different speed.

Figure 14:
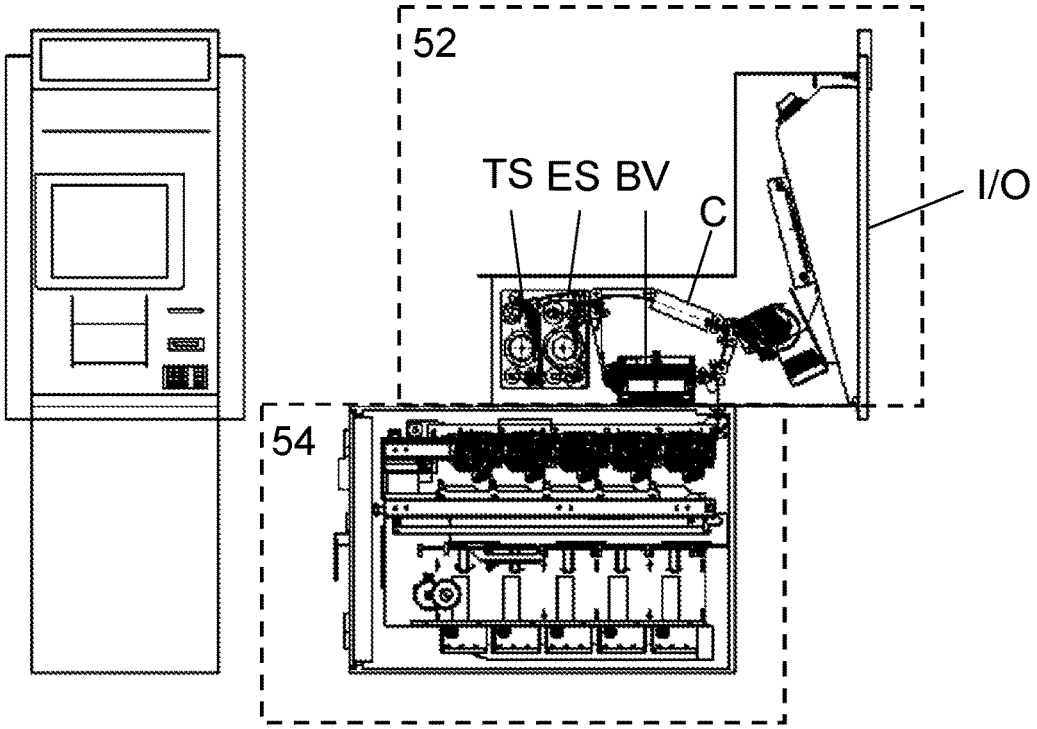

FIG. 14 is a schematic illustration of an ATM where the advanced upper unit is implemented. To the left in the figure is shown a front view of the ATM, and to the right is shown a cross-sectional view of the ATM, where in particular the advanced upper unit 52 is shown.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A stacking and dispensing module for use in an automatic teller machine, the module is configured to be arranged in connection with a banknote storage unit comprising a banknote tray on which banknotes are stacked, the stacking and dispensing module is configured to be in a banknote stacking mode, when banknotes are stacked in said storage unit, and in a banknote dispensing mode, when banknotes are dispensed from said storage unit, the stacking and dispensing module comprises:

a stacking wheel member configured to receive and stack banknotes on said tray, comprising at least two stacking wheels distributed along a common rotation shaft A, a dispensing wheel member configured to dispense banknotes from said tray, comprising a predetermined number of dispensing wheels arranged for rotation around a common first rotation shaft B, the dispensing wheels are configured to be rotated in a first dispensing direction when banknotes are dispensed from the storage unit, wherein said stacking wheel member is active both during the banknote stacking mode and during the banknote dispensing mode, and that the rotation of said stacking wheel member is configured to be controlled by a first direct current (DC) motor, and the rotation of said dispensing wheel member is configured to be controlled by a second DC motor, and the rotation of the stacking wheel member and the rotation of the dispensing wheel member are synchronized and controlled by the first and second DC motors, and wherein the stacking and dispensing module further comprises:

a current measuring unit configured to measure the currents applied to drive said first and second DC motors and to generate current signals in dependence thereto, a control unit configured to receive said current signals, wherein the control unit is configured to evaluate said current signals and to determine control signals for various functions of said stacking and dispensing module in dependence of said evaluation, and to apply said control signals for controlling the functions that are driven by directional rotation and speed of rotation the dispensing wheel member and the stacking wheel member.

2. The stacking and dispensing module according to claim 1, wherein said evaluation of the current signals comprise comparing current values to predetermined threshold values related to the respective functions.

3. The stacking and dispensing module according to claim 1, wherein said functions comprise at least one of controlling the vertical movement of said tray and controlling a dispensing wheel member parameter.

4. The stacking and dispensing module according to claim 3, wherein said dispensing wheel member parameter is related to the thickness of one banknote.

5. The stacking and dispensing module according to claim 1, wherein the control unit is configured to determine a first control signal in dependence of said current signal from said first DC motor, and to apply said first control signal to a tray movement member to perform vertical movement of said tray.

6. The stacking and dispensing module according to claim 1, wherein said stacking wheels are distributed along said common rotation shaft A, such that they essentially cover a major part of a banknote on the banknote tray, thereby performing a levelling of the banknote in a horizontal plane.

7. The stacking and dispensing module according to claim 1, wherein said stacking wheel member comprises four stacking wheels which are symmetrically distributed along said rotation shaft A.

8. The stacking and dispensing module according to claim 1, wherein said stacking wheel member is active in the sense that it is rotated and current is measured both during the banknote stacking mode and banknote dispensing mode.

9. The stacking and dispensing module according to claim 1, wherein the dispensing wheel member is configured to receive banknotes moved from the stack of banknote in the banknote storage unit by a banknote moving member.

10. The stacking and dispensing module according to claim 1, wherein said module comprises a predetermined number of separating rolls for cooperation with the dispensing wheels during movement of banknotes, said separating rolls are arranged for rotation around a common second rotation shaft C, being parallel to shaft B, and wherein a movement member is provided configured to vary the perpendicular distance d between said shafts B and C in dependence of a second control signal from said control unit.

11. The stacking and dispensing module according to claim 10, wherein said dispensing wheels in addition are configured to be rotated in a second returning direction, opposite to said first direction, where banknotes are returned to the banknote storage unit.

12. The stacking and dispensing module according to claim 11, wherein the rotation of the separating rolls is only allowed for cooperating with the dispensing wheels when rotating in the returning direction, but prevented in the opposite direction.

13. The stacking and dispensing module according to claim 1, wherein each stacking wheel is provided with a predetermined number of banknote receiving slots, and that each slot has an essentially semi-circular curvature running from an outer edge of the wheel in a tangential direction in the outer third part of the radius of the stacking wheel, wherein the radius of the slot curvature essentially corresponds, or is slightly shorter, to the radius of the stacking wheel.

14. An automatic teller machine comprising a predetermined number of banknote storage units, wherein each storage unit is provided with a stacking and dispensing module according to claim 1.

15. The automatic teller machine according to claim 14, wherein the machine comprises an advanced upper unit comprising an input/output module adapted to receive and/or dispense banknotes, a detection unit configured for passage of banknotes in one direction and arranged to detect various parameters of banknotes to determine if a banknote is accepted or not accepted, an intermediate storage module comprising two drum storage units including a first drum storage unit for accepted banknotes and a second drum storage unit for non-accepted banknotes.

16. The automatic teller machine according to claim 15, wherein non-accepted banknotes are controlled to pass the detection unit at least one more time.

17. The automatic teller machine according to claim 16, wherein the upper unit is provided with a banknote route such that the banknote is turned upside down every consecutive passage through said detection unit.

18. The automatic teller machine according to claim 15, wherein non-accepted banknotes stored in said second drum storage unit are controlled to pass the detection unit at least one more time.

19. The automatic teller machine according to claim 15, wherein said upper unit comprises a banknote adjusting unit configured to adjust said banknote on a transport path to be in a central position of said path.

20. The automatic teller machine according to claim 19, wherein said banknote adjusting unit comprises one or more omni-wheels.

* * * * *